US009500982B2

(12) United States Patent
Mashiki

(10) Patent No.: US 9,500,982 B2
(45) Date of Patent: Nov. 22, 2016

(54) SENSOR DEVICE, TONER CONCENTRATION DETECTION METHOD AND IMAGE FORMING APPARATUS

(71) Applicant: KYOCERA Document Solutions Inc., Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/079,995

(22) Filed: Mar. 24, 2016

(65) Prior Publication Data

US 2016/0291508 A1 Oct. 6, 2016

(30) Foreign Application Priority Data

Mar. 31, 2015 (JP) ..... 2015-071213

(51) Int. Cl.
*G03G 15/08* (2006.01)

(52) U.S. Cl.
CPC ..... *G03G 15/0825* (2013.01); *G03G 15/0824* (2013.01); *G03G 15/0829* (2013.01); *G03G 15/0849* (2013.01); *G03G 15/0851* (2013.01); *G03G 15/0853* (2013.01)

(58) Field of Classification Search
CPC ..... G03G 15/0824; G03G 15/0825; G03G 15/0829; G03G 15/0849; G03G 15/0851; G03G 15/0853
USPC ..... 399/30
See application file for complete search history.

(56) References Cited

U.S. PATENT DOCUMENTS 3,999,687 A * 12/1976 Baer ..... G03G 15/0853 118/689
2002/0154918 A1* 10/2002 Sawayama ..... G03G 15/0853 399/63
2004/0150438 A1* 8/2004 Jung ..... G06F 7/68 327/119
2006/0127111 A1* 6/2006 Komori ..... G03G 15/0853 399/30
2010/0290795 A1* 11/2010 Seki ..... G03G 15/0853 399/30

FOREIGN PATENT DOCUMENTS

JP 08271481 A * 10/1996
JP H 8-271481 A 10/1996

* cited by examiner

*Primary Examiner* — David Gray
*Assistant Examiner* — Tyler Hardman
(74) *Attorney, Agent, or Firm* — Stein IP, LLC

(57) ABSTRACT

The detection sensitivity of a variation in resonant frequency is increased, and thus a toner concentration is accurately detected. In a sensor device that includes an LC resonant circuit which outputs a pulse signal having a frequency corresponding to the toner concentration, a multiplier portion which multiplies the pulse signal output from the LC resonant circuit and a concentration detection portion which detects the toner concentration based on the pulse signal multiplied by the multiplier portion, the LC resonant circuit includes a detection coil and a capacitor and outputs a pulse signal having a frequency corresponding to the toner concentration. The multiplier portion multiplies the frequency of the pulse signal output from the LC resonant circuit. The concentration detection portion subtracts a predetermined offset pulse number from the pulse signal multiplied by the multiplier portion and detects the toner concentration based on the subtracted pulse number.

8 Claims, 6 Drawing Sheets

SENSOR DEVICE, TONER CONCENTRATION DETECTION METHOD AND IMAGE FORMING APPARATUS

INCORPORATION BY REFERENCE

This application is based upon and claims the benefit of priority from the corresponding Japanese Patent Application No. 2015-071213 filed on Mar. 31, 2015, the entire contents of which are incorporated herein by reference.

BACKGROUND

The present disclosure relates to a technology for detecting the toner concentration of a two-component developer in which a carrier formed of a magnetic material and a toner are mixed.

A toner concentration sensor is known that detects a toner concentration by utilizing the fact that when the ratio of a toner to a carrier in a two-component developer is changed, the resonant frequency of an LC resonant circuit including a detection coil is changed. For example, a toner concentration sensor has already been proposed in which since the resonant frequency of an LC resonant circuit is changed, and thus the pulse number of a pulse signal output from the LC resonant circuit is changed, the pulse number is counted, with the result that the toner concentration is detected.

SUMMARY

Incidentally, the range of a variation in the resonant frequency of an LC resonant circuit according to a toner concentration is so small as to be about a few percent with respect to the resonant frequency. Hence, the detection sensitivity of a variation in the resonant frequency is significantly low, and thus it is not easy to accurately detect the toner concentration from a variation in the resonant frequency. Therefore, in a conventional toner concentration sensor, a measure for the low detection sensitivity of a variation in the resonant frequency is not taken at all, with the result that it is disadvantageously impossible to accurately detect the toner concentration.

According to an aspect of the present disclosure, there is provided a sensor device that is accommodated in a development device and that detects the toner concentration of a two-component developer containing a carrier formed of a magnetic material and a toner, the sensor device including: an LC resonant circuit which includes a detection coil and a capacitor and which outputs a pulse signal having a frequency corresponding to the toner concentration; a multiplier portion which multiplies the pulse signal output from the LC resonant circuit; and a concentration detection portion which subtracts, in each of a plurality of sampling periods, a predetermined offset pulse number from the pulse signal multiplied by the multiplier portion and which detects the toner concentration based on the subtracted pulse number.

The present disclosure may provide a toner concentration detection method using the sensor device configured as described above or may provide an image forming apparatus that includes the sensor device configured as described above.

DETAILED DESCRIPTION

<Description of Sensor Device>

Figure 1:
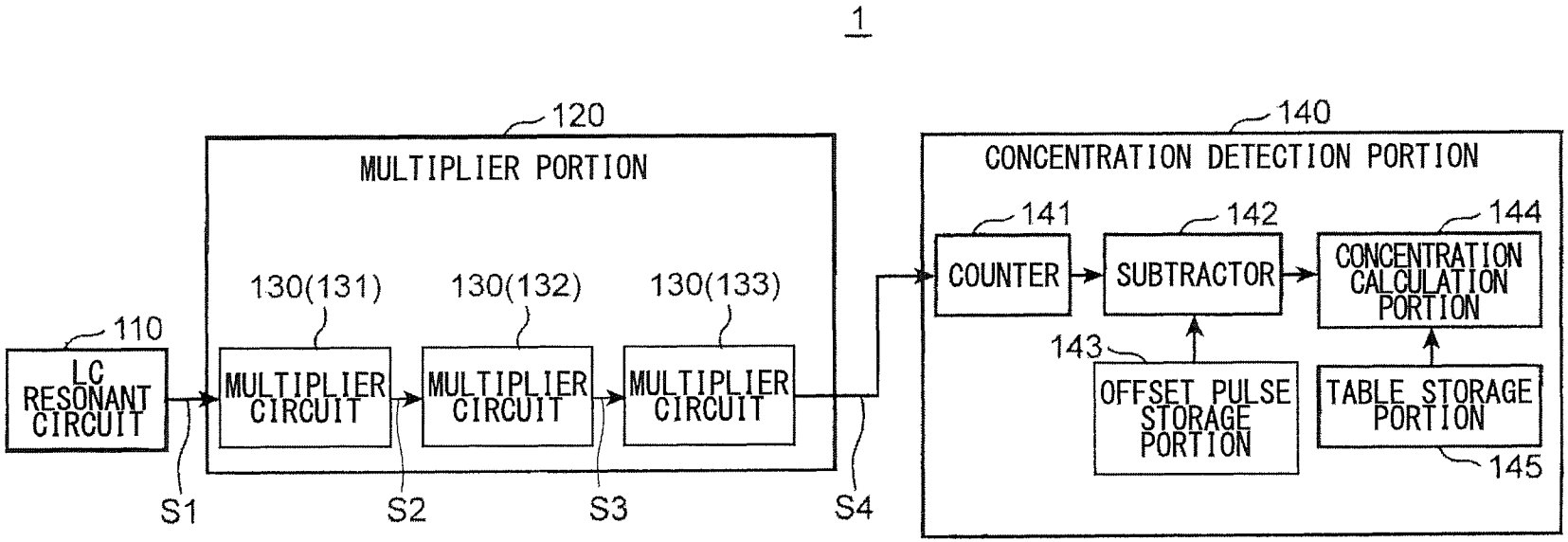
FIG. 1 is a block diagram showing an overall configuration of a sensor device in an embodiment of the present disclosure.

An embodiment of the present disclosure will be described in detail below with reference to drawings. FIG. 1 is a block diagram showing an overall configuration of a sensor device 1 in the embodiment of the present disclosure. The sensor device 1 includes an LC resonant circuit 110, a multiplier portion 120 and a concentration detection portion 140. The sensor device 1 detects the toner concentration of a two-component developer in which a carrier formed of a magnetic material and a toner formed of a resin are mixed.

The LC resonant circuit 110 includes a detection coil and a capacitor, and outputs a pulse signal S1 which has a frequency corresponding to the toner concentration. The multiplier portion 120 multiplies the frequency of the pulse signal S1 output from the LC resonant circuit 110. The multiplier portion 120 has a plurality of multiplier circuits 130 which are cascaded. Although in the example of FIG. 1, the multiplier portion 120 has three multiplier circuits 131, 132 and 133 which are cascaded, this configuration is one example, and the multiplier portion 120 may be formed with M (M is an integer of one or more) multiplier circuits 130.

The multiplier circuits 130 are formed with, for example, doubler circuits. However, this configuration is one example, and the multiplier circuits 130 may be formed with n (n is an integer of two or more) multiplier circuits. The multiplier circuit 131 doubles the pulse signal S1 output from the LC resonant circuit 110. The multiplier circuit 132 doubles a pulse signal S2 output from the multiplier circuit 131. The multiplier circuit 133 doubles a pulse signal S3 output from the multiplier circuit 132.

Hence, the frequency of the pulse signal S2 is twice as high as that of the pulse signal S1. The frequency of the pulse signal S3 is four times as high as that of the pulse signal S1. The frequency of a pulse signal S4 output from the multiplier circuit 133 is eight times as high as that of the pulse signal S1.

The concentration detection portion 140 subtracts a predetermined offset pulse number in each of the sampling periods of the pulse signal S4 which is multiplied by the multiplier portion 120, and detects the toner concentration based on the subtracted pulse number.

Specifically, the concentration detection portion 140 includes a counter 141, a subtractor 142, an offset pulse storage portion 143, a concentration calculation portion 144 and a table storage portion 145.

In each sampling period, the counter 141 counts the pulse number of the pulse signal S4. In each sampling period, the subtractor 142 subtracts the offset pulse number from the pulse number of the pulse signal S4 counted by the counter 141. Hereinafter, the pulse number subtracted by the subtractor 142 is referred to as a "differential pulse number". The offset pulse storage portion 143 is formed with, for example, a nonvolatile storage device, and previously stores the offset pulse number.

Here, in the pulse signal 51 output from the LC resonant circuit 110, the pulse number which is not changed according to the toner concentration in the sampling period is specified as a fixed pulse number component, and the pulse number which is changed according to the range of a variation in the toner concentration is specified as a variable pulse number component.

In this case, the offset pulse number is set based on the fixed pulse number component. Specifically, as the offset pulse number, the pulse number obtained by multiplying the fixed pulse number component with the multiplier portion 120 can be adopted. In the example of FIG. 1, since the multiplication number of the multiplier portion 120 is 8, as the offset pulse number, the pulse number which is eight times as high as the fixed pulse number component is adopted.

However, the present disclosure is not limited to this configuration. For example, it is assumed that in the total pulse number in the sampling period, the proportion of the variable pulse number component is, for example, 5%, and that the remaining 95% is the proportion of the fixed pulse number component. In this case, a predetermined number of pulses equal to or less than the pulse number of 95% in the total pulse number in the sampling period input to the concentration detection portion 140 can be adopted as the offset pulse number.

The concentration calculation portion 144 calculates the toner concentration corresponding to the differential pulse number calculated by the subtractor 142 with reference to a correspondence table stored in the table storage portion 145. The table storage portion 145 is formed with, for example, a nonvolatile storage device, and stores the correspondence table in which a relationship between the differential pulse number and the toner concentration corresponding to the differential pulse number is previously associated.

Figure 2:
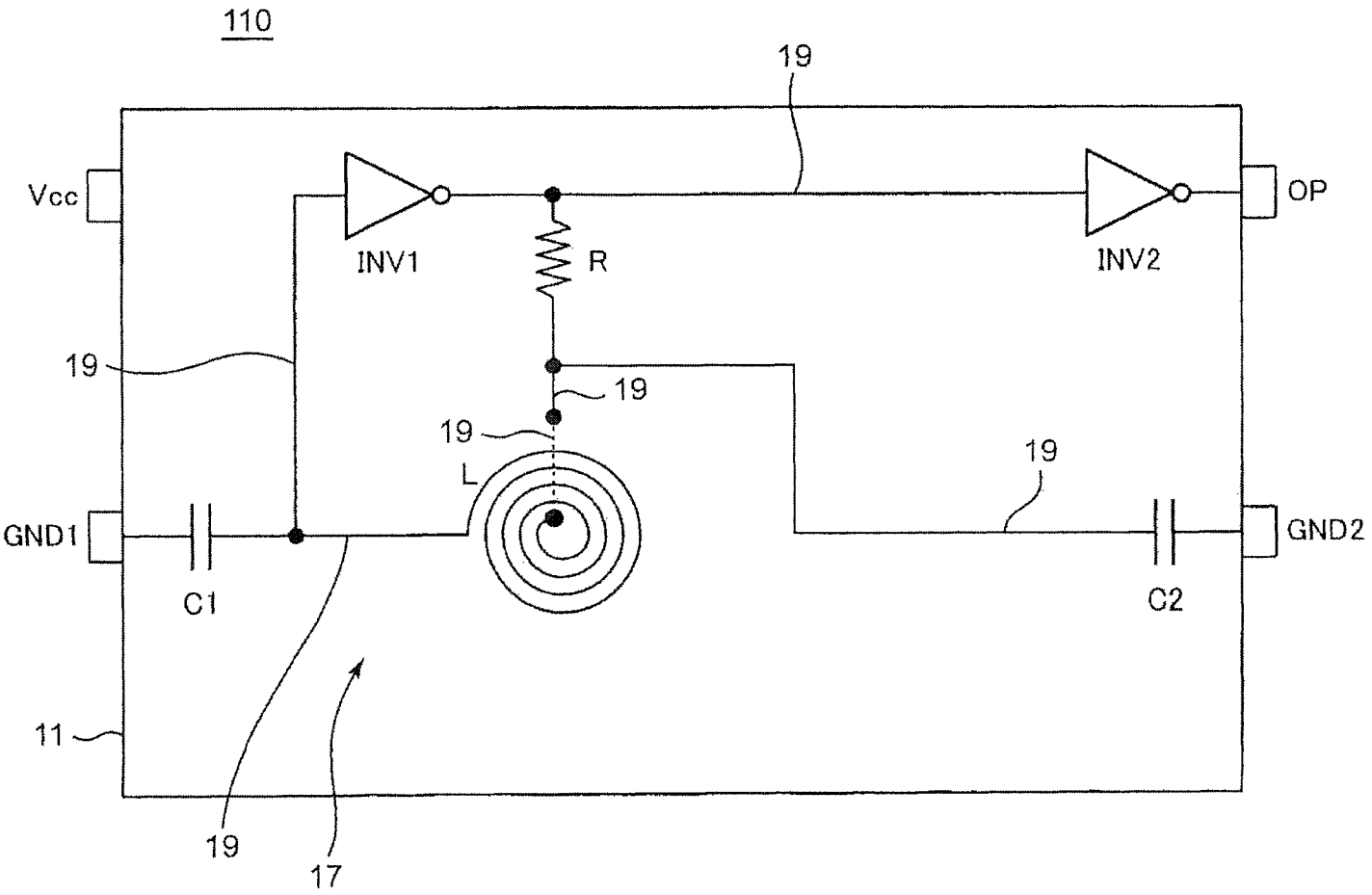
FIG. 2 is a plan view of an LC resonant circuit in the embodiment of the present disclosure.
Figure 3:
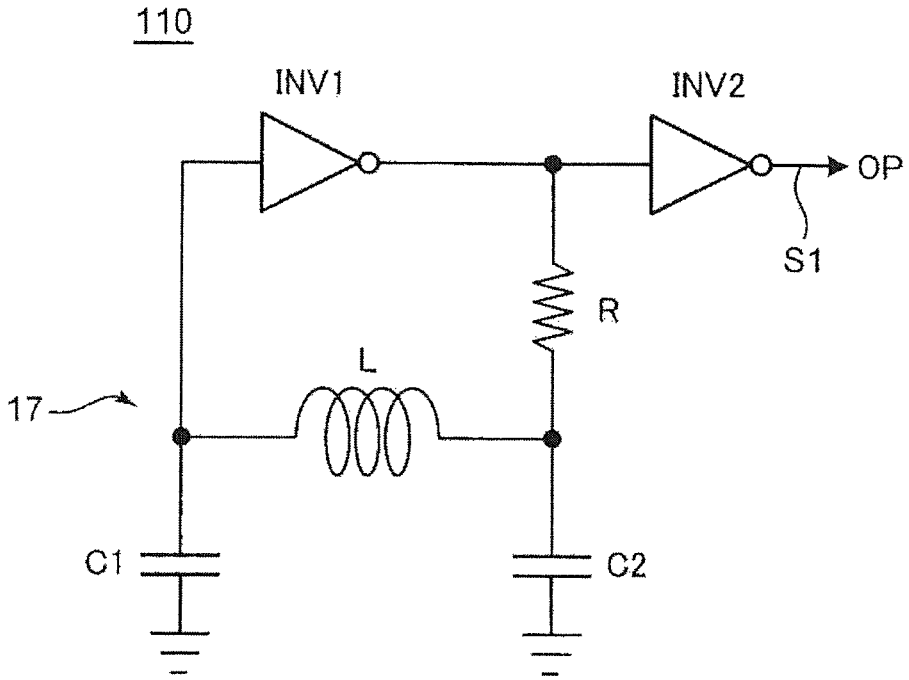
FIG. 3 is a circuit diagram of the LC resonant circuit in the embodiment of the present disclosure.

FIG. 2 is a plan view of the LC resonant circuit 110 in the embodiment of the present disclosure. The LC resonant circuit 110 includes a substrate 11, a detection coil L, a capacitor C1, a capacitor C2, an inverter INV1, an inverter INV2 and a resistor R. FIG. 3 is a circuit diagram of the LC resonant circuit 110 in the embodiment of the present disclosure.

With reference to FIG. 3, the detection coil L, the capacitor C1 and the capacitor C2 form an LC resonant portion 17. As the LC resonant portion 17, a CLC type will be described but there is no limitation on this type. For example, an LC type may be used. The LC type refers to an LC resonant portion 17 which is formed with one detection coil and one capacitor.

One end of the detection coil L and one end of the capacitor C1 are connected together, and the other end of the capacitor C1 is grounded. The other end of the detection coil L and one end of the capacitor C2 are connected together, and the other end of the capacitor C2 is grounded.

The inverters INV1 and INV2 are, for example, CMOS inverters. The output of the inverter INV1 is connected to the input of the inverter INV2. The output of the inverter INV2 serves as the output of the sensor device 1.

The input of the inverter INV1 is connected to the one end of the detection coil L. The output of the inverter INV1 and the input of the inverter INV2 are connected through the resistor R to the other end of the detection coil L.

A pulse generated by the resonation of the LC resonant portion 17 is amplified by the inverters INV1 and INV2 in the two stages, and is output from the sensor device 1 as the pulse signal S1.

The operation of the sensor device 1 will be described. The two-component developer is formed with the toner and the carrier made of the magnetic material. For example, when in the vicinity of the detection coil L, the ratio of the toner to the carrier is increased, the magnetic permeability of the two-component developer is lowered, and thus the inductance of the detection coil L is lowered. Here, the resonant frequency fc of the LC resonant circuit 110 is represented by $\frac{1}{2}\pi(L \cdot C)^{1/2}$. In this way, the inductance of the detection coil L is lowered, and thus the resonant frequency fc is increased, with the result that the pulse number output from the LC resonant circuit 110 for a given period of time is increased.

On the other hand, when in the vicinity of the detection coil L, the ratio of the toner to the carrier is decreased, the magnetic permeability of the two-component developer is increased, and thus the inductance of the detection coil L is increased. In this way, the resonant frequency fc is decreased, and thus the pulse number output from the LC resonant circuit 110 for a given period of time is decreased.

Here, in the two-component developer, since in general, only the toner is consumed, and the carrier is collected, the amount of carrier can be considered to be constant. Hence, when the ratio of the toner to the carrier is increased, the toner concentration is increased whereas when the ratio of the toner to the carrier is decreased, the toner concentration is decreased.

Hence, as the pulse number of the pulse signal S4 output from the multiplier portion 120 for a given period of time is increased, the toner concentration is increased, and thus the concentration detection portion 140 can detect the toner concentration from the pulse number of the pulse signal S4.

With reference to FIG. 2, the substrate 11 is an insulating substrate, and on the main surface of the substrate 11, the detection coil L and a wiring 19 are formed by being patterned. The capacitor C1, the capacitor C2, the resistor R and the inverters INV1 and INV2 are externally attached to the main surface of the substrate 11. The detection coil L, the capacitor C1, the capacitor C2, the resistor R and the inverters INV1 and INV2 are connected by the wiring 19 and form the LC resonant circuit 110 shown in FIG. 3.

With reference to FIG. 2, the LC resonant circuit 110 includes a power supply terminal Vcc, a ground terminal GND1, a ground terminal GND2 and an output terminal OP which are further provided on the side portion of the substrate 11. Power is supplied to the LC resonant circuit 110 through the power supply terminal Vcc. The capacitor C1 is grounded through the ground terminal GND1. The capacitor C2 is grounded through the ground terminal GND2. The pulse signal output from the inverter INV2 is output to the multiplier portion 120 through the output terminal OP.

<Description of Development Device>

Figure 4:
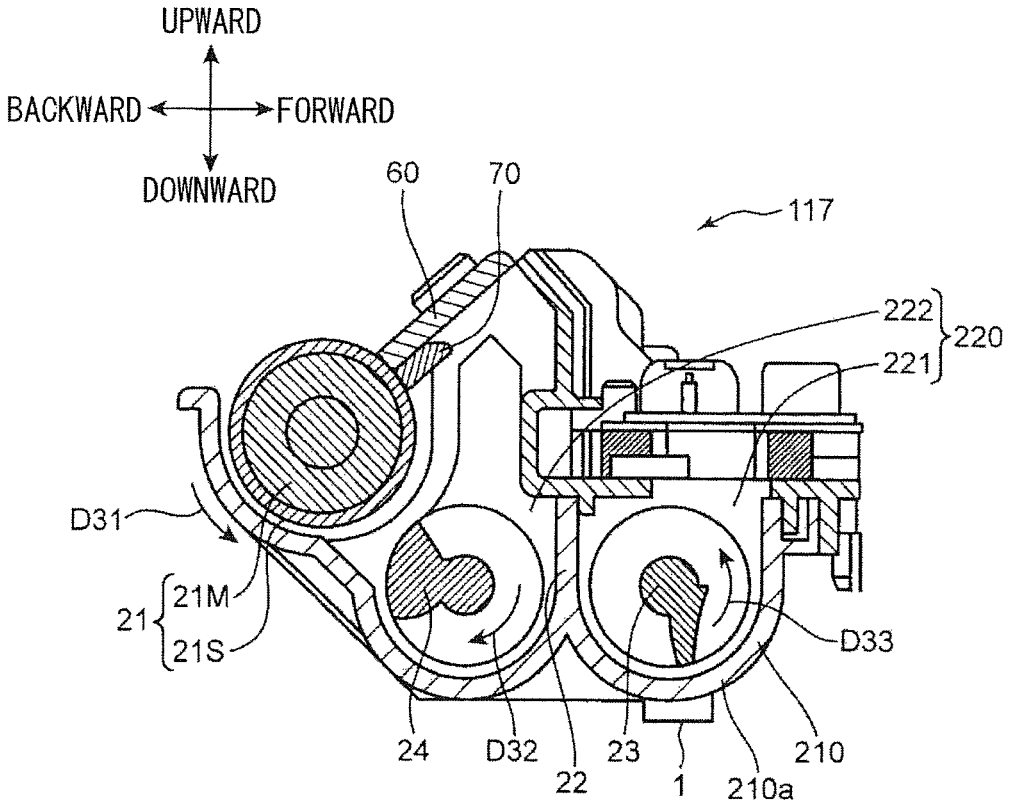
FIG. 4 is a side cross-sectional view showing an internal structure of a development device in the embodiment of the present disclosure.

FIG. 4 is a side cross-sectional view showing an internal structure of a development device 117 in the embodiment of the present disclosure. The development device 117 includes a development housing 210 which is long in the axial direction of a development roller 21 and which is formed in the shape of a box.

In the internal space 220 of the development housing 210, the development roller 21, a first agitation screw 23 and a second agitation screw 24 are arranged. In the internal space 220, the two-component developer is stored. The two-component developer is agitated and transported within the internal space 220.

Between a pair of wall portions provided at both ends of the development housing 210 in the longitudinal direction, the development roller 21 is supported rotatably with respect to the development housing 210, and the toner is carried on its surface. The development roller 21 is formed in the shape of a cylinder, and is provided so as to be extended in the longitudinal direction of the development housing 210. The development roller 21 includes: a sleeve 21S which is driven and rotated and which is formed in the shape of a cylinder; and, within the sleeve 21S, a magnet 21M which is fixedly arranged along the axial direction and which is formed in the shape of a cylinder. The sleeve 21S is driven and rotated by an unillustrated drive means in the direction of an arrow D31 in FIG. 4, and the toner is carried on the circumferential surface. The magnet 21M is a stationary magnet which has, within the sleeve 21S, a plurality of magnetic poles in the circumferential direction of the sleeve 21S.

The internal space 220 of the development housing 210 is partitioned, by a partition plate 22 extending in the axial direction, into a first transport path 221 and a second transport path 222 which are long in the axial direction. The first transport path 221 is arranged in the development housing 210 apart from the development roller 21. The second transport path 222 is arranged between the development roller 21 and the first transport path 221. The partition plate 22 has a first communication path (unillustrated) and a second communication path (unillustrated) which make the first transport path 221 and the second transport path 222 communicate with each other. In this way, in the internal space 220, a developer transport path is formed which leads from the first transport path 221 to the first communication path (unillustrated) to the second transport path 222 and to the second communication path (unillustrated).

The first agitation screw 23 is arranged in the first transport path 221. The first agitation screw 23 includes a rotation shaft and a screw blade which is provided on the circumference of the rotation shaft so as to protrude in the shape of a spiral. The first agitation screw 23 is rotated by an unillustrated drive means in the direction of an arrow D33, and thus the toner is transported in a direction perpendicularly intersecting the plane of the figure.

The second agitation screw 24 is arranged in the second transport path 222. The second agitation screw 24 includes a rotation shaft and a screw blade which is provided on the circumference of the rotation shaft so as to protrude in the shape of a spiral. The second agitation screw 24 is rotated by an unillustrated drive means in the direction of an arrow D32, and thus the toner is transported in the direction perpendicularly intersecting the plane of the figure.

The development device 117 further includes a layer regulation member 60 and a magnet plate 70. The layer regulation member 60 is arranged in a position forward and upward of the development roller 21, and regulates the thickness of the layer of the toner sucked from the second agitation screw 24 onto the sleeve 21S.

The magnet plate 70 is arranged on the front side of the layer regulation member 60 along the layer regulation member 60, generates a magnetic field between the magnet plate 70 and the sleeve 21S and reduces the thickness of the layer of the toner into a thin film.

The sensor device 1 is provided on the outer surface of the bottom wall of a development housing 210*a* which defines the first transport path 221. Here, the development housing 210*a* is formed in the shape of a downward convex semi-cylinder. The sensor device 1 is adhered to the lowermost portion of the development housing 210*a*. In this way, the two-component developer is agitated by the first agitation screw 23, and thus the two-component developer is periodically and repeatedly moved close to and away from the sensor device 1. The sensor device 1 may be provided on the outer surface of the bottom wall of the development housing 210 corresponding to the second transport path 222.

(Multiplier Circuit)

Figure 5:
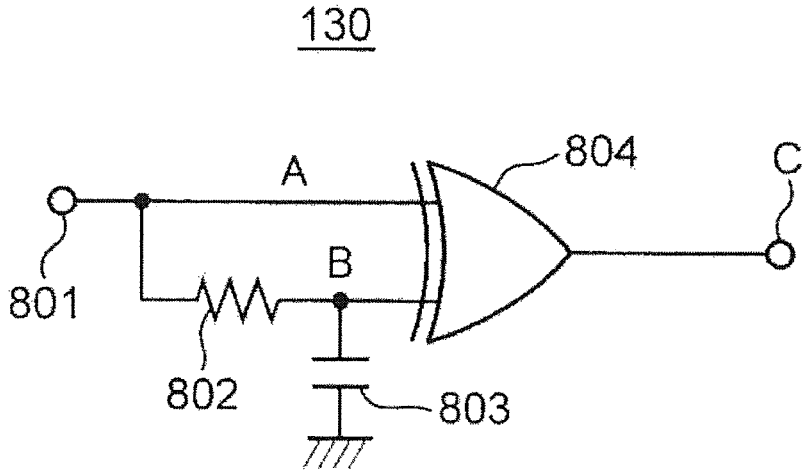
FIG. 5 is a circuit diagram of a multiplier circuit shown in FIG. 1.

FIG. 5 is a circuit diagram of the multiplier circuit 130 shown in FIG. 1. The multiplier circuit 130 includes an input port 801, a resistor 802, a capacitor 803 and an EXOR circuit 804. The input port 801 is connected to the input port A of the EXOR circuit 804, and the input port 801 is connected to the input port B of the EXOR circuit 804 through the resistor 802. The input port B is grounded through the capacitor 803.

Either the LC resonant circuit 110 shown in FIG. 1 or the output port C of the multiplier circuit 130 connected to the preceding stage is connected to the input port 801, and either the multiplier circuit 130 connected to the subsequent stage or the concentration detection portion 140 is connected to the output port C.

Figure 6:
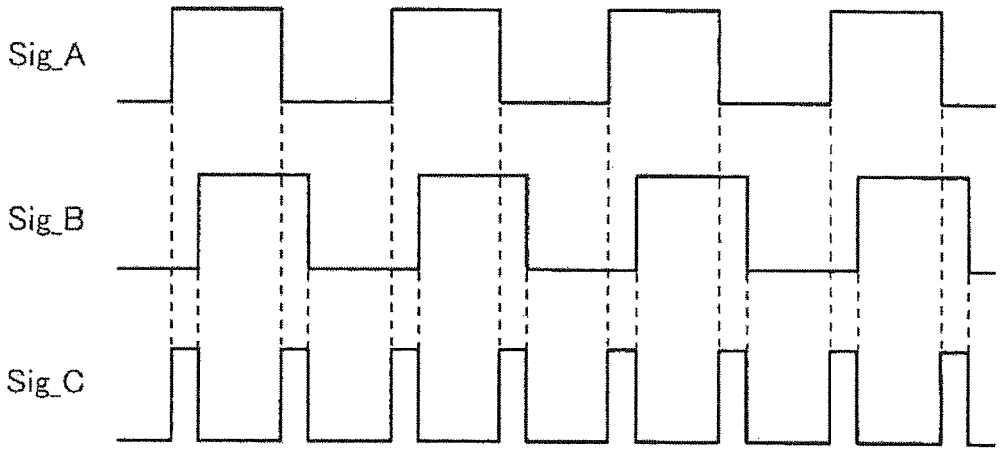
FIG. 6 is a waveform diagram showing an input signal to an EXOR circuit and an output signal.

FIG. 6 is a waveform diagram showing an input signal to the EXOR circuit 804 and an output signal. In FIG. 6, an upper stage indicates a signal Sig_A input to the input port A, an intermediate state indicates a signal Sig_B input to the input port B and a lower stage indicates a signal Sig_C output form the output port C.

The signal Sig_A input from the input port 801 is input to the input port A. A CR circuit formed with the resistor 802 and the capacitor 803 delays a signal input from the input port 801. Hence, the signal Sig_B which is delayed a predetermined time with respect to the Sig_A is input to the input port B.

In a period during which the logic of the signal Sig_A does not match the logic of the signal Sig_B, a high-level signal is output from the output port C whereas in a period during which the logic of the signal Sig_A matches the logic of the signal Sig_B, a low-level signal is output from the output port C. In this way, the signal Sig_C has pulses on the rising edge and on the falling edge of the signal Sig_A, and is a signal which is obtained by doubling the Sig_A.

Figure 7:
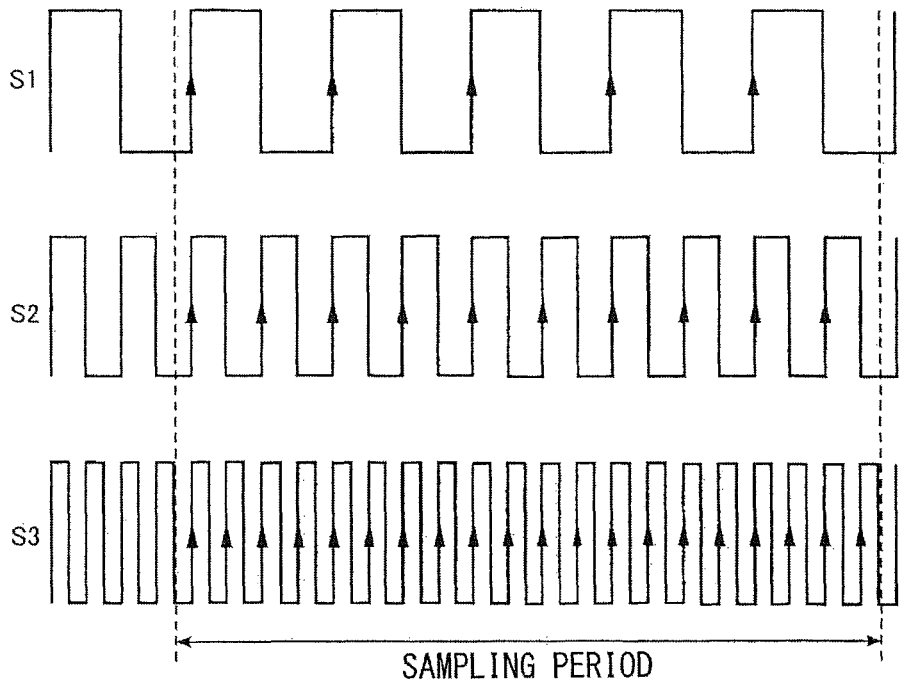
FIG. 7 is a waveform diagram of pulse signals S1 to S3 in the embodiment of the present disclosure.

FIG. 7 is a waveform diagram of the pulse signal S1 output from the LC resonant circuit 110, the pulse signal S2 output from the multiplier circuit 131 and the pulse signal S3 output from the multiplier circuit 132 in the embodiment of the present disclosure. An upper stage indicates the pulse signal S1, an intermediate stage indicates the pulse signal S2 and a lower stage indicates the pulse signal S3.

The sampling period is a basic period when the concentration detection portion 140 counts the pulse number of the pulse signal S4, and has a previously determined constant value. The concentration detection portion 140 counts the pulse number of the pulse signal S4 every sampling period.

In the pulse signal S1, the rising edge and the falling edge are detected by the multiplier circuit 131, and the pulse signal S1 is doubled. In this way, it is possible to obtain the pulse signal S2 whose frequency is twice as high as that of the pulse signal S1. In the pulse signal S2, the rising edge and the falling edge are detected by the multiplier circuit 132, and the pulse signal S2 is doubled. In this way, it is possible to obtain the pulse signal S3 whose frequency is four times as high as that of the pulse signal S1.

In this way, the pulse signal S1 which has only 5 pulses in the sampling period is multiplied by 4, and thus it is possible to obtain the pulse signal S3 which has 20 pulses in the sampling period. In the present embodiment, since the multiplier portion 120 multiplies the pulse signal S1 by 8, the pulse number which is input to the concentration detection portion 140 in the sampling period is 40 in the example of FIG. 7.

The pulse signal S4 obtained by multiplying the pulse signal S1 by 8 is input to the concentration detection portion 140. In each sampling period, the concentration detection portion 140 subtracts the offset pulse number from the pulse number of the pulse signal S4 which is input. Hence, the proportion of the pulse number indicating the range of a variation in the resonant frequency in the total pulse number included in the sampling period is increased, and thus the detection sensitivity of a variation in the resonant frequency is increased.

Here, since the two-component developer stored within the development device 117 is agitated, the two-component developer is periodically and repeatedly moved close to and away from the sensor device 1. Hence, even when the toner concentration is constant, the resonant frequency fc is changed in one agitation period. Therefore, the concentration detection portion 140 preferably calculates, as the finally determined toner concentration, the average value of toner concentrations detected in a plurality of sampling periods. As the number of sampling periods in which the average value is calculated, for example, the number of sampling periods in one agitation period may be adopted or the number of sampling periods in two or more agitation periods previously determined may be adopted.

Figure 8:
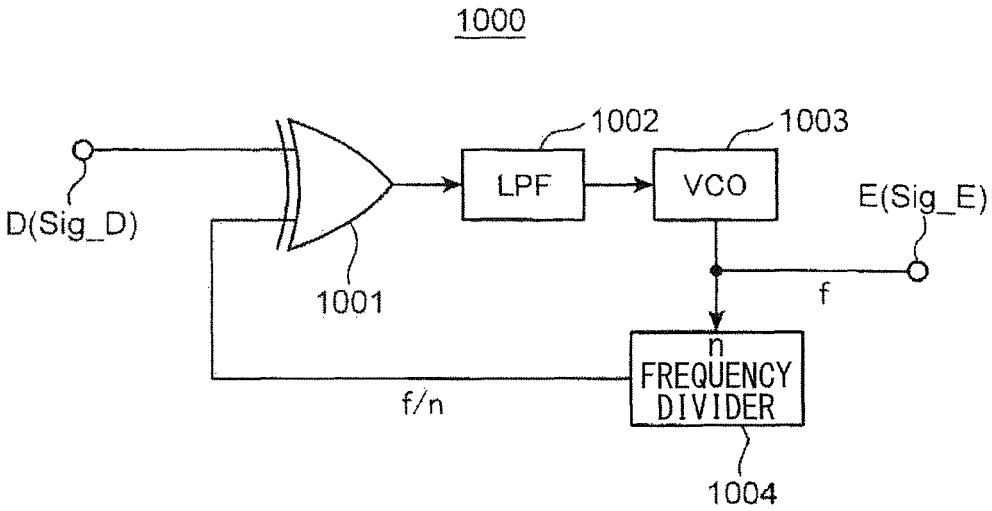
FIG. 8 is a circuit diagram of a PLL circuit.

Although in FIG. 1, the multiplier portion 120 is formed with a plurality of multiplier circuits 130 which are cascaded, the multiplier portion 120 may be formed with, for example, a PLL (Phase Locked Loop) circuit. FIG. 8 is a circuit diagram of the PLL circuit. The PLL circuit 1000 includes an EXOR circuit 1001, a low-pass filter (LPF) 1002, a voltage-controlled oscillator (VCO) 1003 and an n frequency divider 1004.

The LC resonant circuit 110 shown in FIG. 1 is connected to an input port D, and the concentration detection portion 140 shown in FIG. 1 is connected to an output port E.

In the EXOR circuit 1001, a signal Sig_D from the input port D is input to one input port, and a signal having a frequency f/n obtained by dividing the frequency f of a signal Sig_E into n is input from the n frequency divider 1004 to the other input port. The EXOR circuit 1001 outputs, to the LPF 1002, a signal that indicates a phase difference between the signal Sig_D and the signal Sig_E whose frequency is divided into n. The LPF 1002 converts the signal indicating the phase difference into a direct-current signal, and outputs it to the VCO 1003. The VCO 1003 generates the signal Sig_E such that the direct-current signal becomes zero. Here, since the frequency of the signal Sig_E is n times as high as the frequency f of the signal Sig_D, the signal Sig_E obtained by multiplying the signal Sig_D by n is output from the output port E.

When the PLL circuit 1000 is used, the dividing ratio of the n frequency divider 1004 is varied, and thus it is possible to change the multiplication number of the signal Sig_E. Hence, the multiplier portion 120 changes the dividing ratio of the n frequency divider 1004 according to a setting value shown in FIG. 1.

(Image Forming Apparatus)

Figure 9:
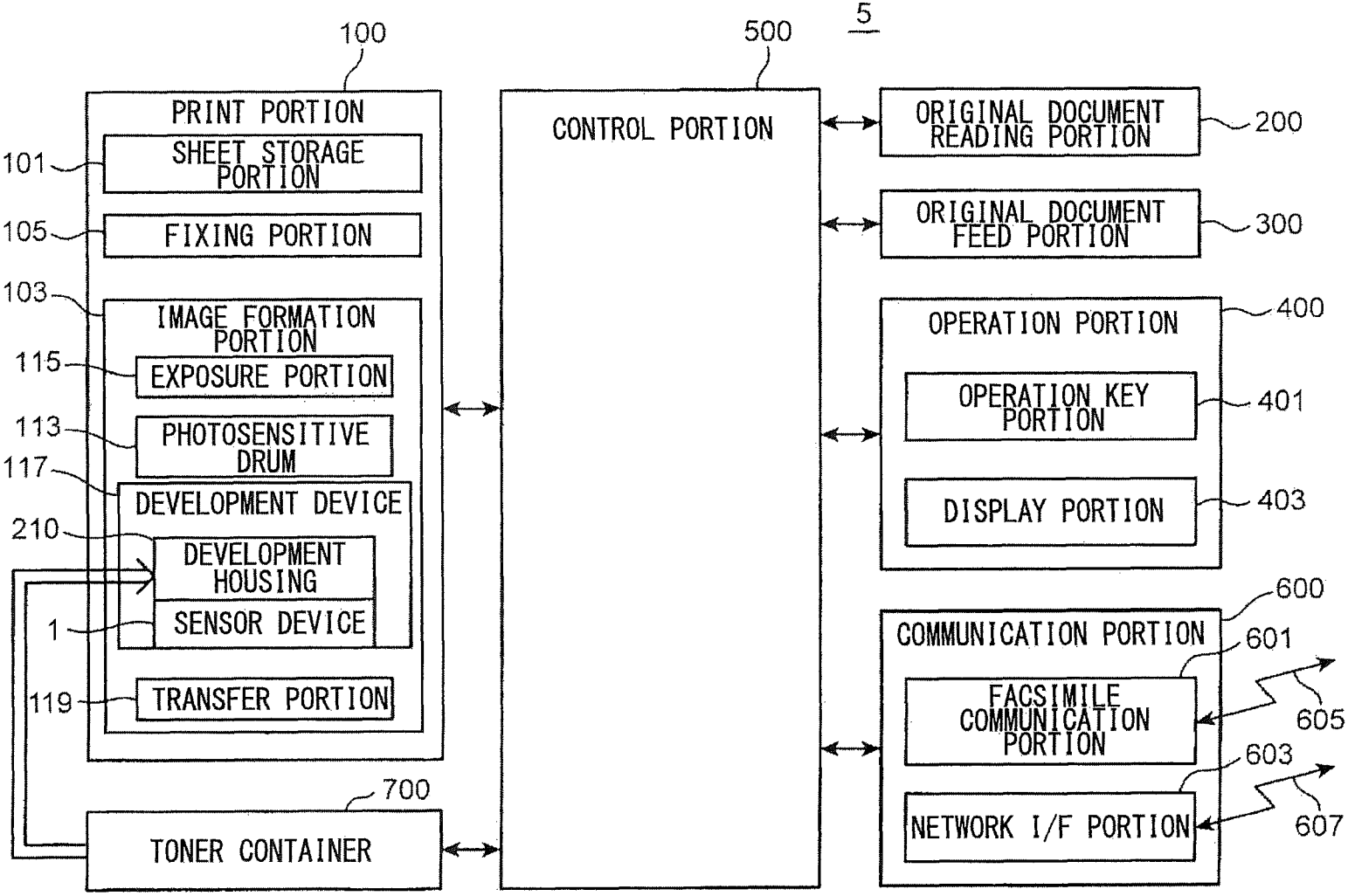
FIG. 9 is a block diagram showing the configuration of an image forming apparatus incorporated in a sensor device 1 according to the present embodiment.

The sensor device 1 according to the present embodiment can be incorporated in an image forming apparatus. FIG. 9 is a block diagram showing the configuration of an image forming apparatus 5 incorporated in the sensor device 1 according to the present embodiment.

The image forming apparatus 5 will be described using, as an example, a digital multifunctional machine which has the functions of a copying machine, a printer, a scanner and a facsimile machine. As long as the image forming apparatus 5 is an apparatus which has the function of printing an image, the image forming apparatus 5 is not limited to a digital multifunctional machine. For example, a printer may be used as the image forming apparatus 5. The image forming apparatus 5 includes a print portion 100, an original document reading portion 200, an original document feed portion 300, an operation portion 400, a control portion 500, a communication portion 600 and a toner container 700.

When one original document is placed on an original document placement portion provided in the original document feed portion 300, the original document feed portion 300 feeds the original document to the original document reading portion 200 whereas when a plurality of original documents are placed on the original document placement portion, the original document feed portion 300 continuously feeds a plurality of original documents to the original document reading portion 200.

The original document reading portion 200 reads an original document placed on an original document stage or an original document fed from the original document feed portion 300, and outputs image data on the original document.

The print portion 100 includes a sheet storage portion 101, an image formation portion 103 and a fixing portion 105. The sheet storage portion 101 can store a stack of sheets. Among the stack of sheets stored, the uppermost sheet is fed out by the drive of a pickup roller (unillustrated) toward a sheet transport path (unillustrated). The sheet is transported along the sheet transport path to the image formation portion 103.

The image formation portion 103 forms a toner image on the sheet transported. The image formation portion 103 includes a photosensitive drum 113, an exposure portion 115, the development device 117 and a transfer portion 119. The exposure portion 115 generates light which is modulated according to image data (such as image data output from the original document reading portion 200, image data transmitted from a personal computer or image data obtained by facsimile reception), and applies it to the circumferential surface of the photosensitive drum 113 which is uniformly charged. In this way, on the circumferential surface of the photosensitive drum 113, an electrostatic latent image corresponding to the image data is drawn. In this state, the toner is supplied to the circumferential surface of the photosensitive drum 113 from the development device 117, and thus a toner image corresponding to the image data is formed on the circumferential surface. The toner image is transferred to the sheet which is transported by the transfer portion 119 from the sheet storage portion 101 described above.

The sheet to which the toner image is transferred is fed to the fixing portion 105. In the fixing portion 105, heat and pressure are applied to the toner image and the sheet, and thus the toner image is fixed to the sheet. The sheet is ejected into a paper ejection tray (unillustrated).

In the development housing 210 of the development device 117, the two-component developer is stored. The sensor device 1 shown in FIG. 1 is attached to the outer surface of the bottom wall of the development housing 210.

The sensor device 1 detects the toner concentration in the two-component developer stored in the development housing 210.

When the toner in the development housing 210 is consumed, and the sensor device 1 detects that the toner concentration in the two-component developer is lowered, the control portion 500 operates a toner supply mechanism provided in the toner container 700. In this way, the toner is supplied from the toner container 700 to the development housing 210.

The operation portion 400 includes an operation key portion 401 and a display portion 403. The display portion 403 has a touch panel function, and a screen including a soft key is displayed. A user operates the soft key while seeing the screen, and thereby makes a setting and the like necessary for performing the function of copying and the like.

In the operation key portion 401, an operation key formed with a hard key is provided. The operation key is a function switching key for switching between, for example, a start key, a numeric keypad, a reset key, a copying machine, a printer, a scanner and a facsimile machine.

The control portion 500 includes a CPU, a ROM and a RAM. The CPU performs control necessary for operating the image forming apparatus 5 on the above constituent elements (for example, the print portion 100) of the image forming apparatus 5. The ROM stores software necessary for controlling the operation of the image forming apparatus 5. The RAM is utilized for the temporarily storage of data produced when software is executed, the storage of application software and the like.

The communication portion 600 includes a facsimile communication portion 601 and a network I/F portion 603. The facsimile communication portion 601 includes an NCU (Network Control Unit) which controls the connection of a telephone line to a destination facsimile and a modulation/demodulation circuit which modulates and demodulates a signal for facsimile communication. The facsimile communication portion 601 is connected to the telephone line 605.

The network I/F portion 603 is connected to a LAN (Local Area Network) 607. The network I/F portion 603 is a communication interface circuit for performing communication between the network I/F portion 603 and a personal computer connected to the LAN 607.

(Effects of Sensor Device)

(1) The pulse signal output from the LC resonant circuit 110 is multiplied by the multiplier portion 120, and simultaneously, in each sampling period, the predetermined offset pulse number is subtracted. Hence, the proportion of the pulse number indicating the range of a variation in the resonant frequency in the total pulse number included in the sampling period is increased. In this way, the detection sensitivity of a variation in the resonant frequency is increased, and thus it is possible to accurately detect the toner concentration.

(2) Since the multiplier portion 120 is formed with a plurality of multiplier circuits 130 which are cascaded, the number of connections of the multiplier circuits 130 is changed, and thus it is possible to output a pulse signal of a desired multiplication number to the concentration detection portion 140.

(3) Since the multiplier circuit 130 detects the edge of the pulse signal which is input, the pulse signal which is input can be doubled.

(4) Since the offset pulse number is set based on the fixed pulse number component which is not changed according to the toner concentration, without affecting the pulse number indicating a variation in the toner concentration, it is possible to subtract the offset pulse number in the sampling period.

(Variations)

The subtractor 142 may reduce the offset pulse number from the pulse signal S4 by reducing "1" from the value of the most significant bit of a count value counted by the counter 141. Preferably, in this case, for example, when it is assumed that the number of bits of the pulse signal S4 is m (m is an integer of two or more) bits, the number of connections of the multiplier circuits 130 is previously adjusted such that bits from the first bit to the (m-1)th bit are a component which is varied according to the toner concentration and that a symbol sequence where the m-th bit is "1" and all of the remaining (m-1) bits are 0 is a component which is not varied according to the toner concentration. In this case, the offset pulse storage portion 143 is not necessary, and simultaneously it is possible to simplify the reduction processing.

For example, when m=5, the number of connections of the multiplier circuits 130 is adjusted such that "1, 0, 0, 0, 0" is the component which is not varied according to the toner concentration. For example, it is assumed that in the pulse signal S1, the bit sequence of the component which is not varied according to the toner concentration is represented by "0, 0, 1, 0, 0". This can be realized by adjusting the inductance of the detection coil L, the capacitance of the capacitors C1 and C2 and the sampling period. In this case, "0, 0, 1, 0, 0" is multiplied by 4, and thus the bit sequence of the component which is not varied according to the toner concentration can be changed to "1, 0, 0, 0, 0". Hence, in this case, the number of multiplier circuits 130 is preferably set to 2.

As described above, the sensor device 1 according to the present disclosure is accommodated in the development device, detects the toner concentration of the two-component developer containing the carrier formed of the magnetic material and the toner and includes: the LC resonant circuit 110 which includes the detection coil and the capacitor and which outputs the pulse signal S1 having a frequency corresponding to the toner concentration; the multiplier portion 120 which multiplies the pulse signal S1 output from the LC resonant circuit 110; and the concentration detection portion 140 which subtracts, in each of a plurality of sampling periods, the predetermined offset pulse number from the pulse signal S4 multiplied by the multiplier portion 120 and which detects the toner concentration based on the subtracted pulse number.

In this configuration, the pulse signal S1 output from the LC resonant circuit 110 is multiplied by the multiplier portion 120, and simultaneously, the predetermined offset pulse number is subtracted in each sampling period. Hence, the proportion of the pulse number indicating the range of a variation in the resonant frequency in the total pulse number included in the sampling period is increased. In this way, the detection sensitivity of a variation in the resonant frequency is increased, and thus it is possible to accurately detect the toner concentration.

In the sensor device 1, the multiplier portion 120 may be formed with a plurality of multiplier circuits 130 (131 to 133) which are cascaded.

In this configuration, the number of connections of the multiplier circuits which are cascaded is changed, and thus it is possible to input the pulse signal of a desired multiplication number to the concentration detection portion 140.

In the sensor device 1, the multiplier circuits 130 may be formed with an edge detection circuit which detects the edge of the pulse signal which is input.

In this configuration, since the edge of the pulse signal which is input is detected, the pulse signal can be doubled.

In the sensor device 1, in the sampling period, the pulse signal S1 output from the LC resonant circuit 110 may include the fixed pulse number component which is not changed according to the toner concentration, and the offset pulse number may be set based on the fixed pulse number component.

In this configuration, since the offset pulse number is set based on the fixed pulse number component which is not changed according to the toner concentration, without affecting the pulse number indicating a variation in the toner concentration, it is possible to subtract the offset pulse number in the sampling period.

In the sensor device 1, the concentration detection portion 140 may include: the counter 141 of m (m is an integer of two or more) bits which counts, in each of the sampling periods, the pulse number of the pulse signal that is input; and the subtractor 142 which reduces, in each of the sampling periods, "1" from the value of the m-th bit that is the most significant bit of a count value counted, and the multiplier portion 120 may multiply the pulse signal S1 output from the LC resonant circuit 110 such that a bit sequence where the m-th bit of the count value is "1" and the remaining bits are "0" is a component which is not changed according to the toner concentration.

In this configuration, the multiplication number is adjusted such that the bit sequence where the m-th bit of the count value is "1" and the remaining bits are "0" is a component which is not changed according to the toner concentration. Hence, the subtractor can perform the processing for reducing the offset pulse number only by changing the value of the m-th bit in the count value by the counter from "1" to "0". Thus, it is not necessary to separately provide a memory which stores the offset pulse number, and simultaneously it is possible to simplify the reduction processing.

As described above, in the present disclosure, the detection sensitivity of a variation in the resonant frequency of the LC resonant circuit corresponding to the toner concentration is increased, and thus it is possible to accurately detect the toner concentration.

Hence, in a toner concentration detection method using the sensor device configured as described above, it is possible to accurately detect the toner concentration.

In an image forming apparatus including the sensor device configured as described above, it is possible to accurately detect the toner concentration, with the result that it is possible to provide the image forming apparatus which has high performance of image formation.

What is claimed is:

1. A sensor device that is accommodated in a development device and that detects a toner concentration of a two-component developer containing a carrier formed of a magnetic material and a toner, the sensor device comprising:

an LC resonant circuit which includes a detection coil and a capacitor and which outputs a pulse signal having a frequency corresponding to the toner concentration;

a multiplier portion which multiplies the pulse signal output from the LC resonant circuit; and a concentration detection portion which subtracts, in each of a plurality of sampling periods, a predetermined offset pulse number from the pulse signal multiplied by the multiplier portion and which detects the toner concentration based on the subtracted pulse number.

2. The sensor device according to claim 1, wherein the multiplier portion is formed with a plurality of multiplier circuits which are cascaded.

3. The sensor device according to claim 2, wherein the multiplier circuits are formed with an edge detection circuit which detects an edge of a pulse signal that is input.

4. The sensor device according to claim 1, wherein in the sampling period, the pulse signal output from the LC resonant circuit includes a fixed pulse number component which is not changed according to the toner concentration, and the offset pulse number is set based on the fixed pulse number component.

5. The sensor device according to claim 1, wherein the multiplier portion is formed with a plurality of multiplier circuits which are cascaded, the multiplier circuits are formed with an edge detection circuit which detects an edge of a pulse signal that is input, in the sampling period, the pulse signal output from the LC resonant circuit includes a fixed pulse number component which is not changed according to the toner concentration, and the offset pulse number is set based on the fixed pulse number component.

6. The sensor device according to claim 1, wherein the concentration detection portion includes: a counter of m (m is an integer of two or more) bits which counts a pulse number of a pulse signal that is input; and a subtractor which reduces, in each of the sampling periods, "1" from a value of an m-th bit that is a most significant bit of a count value that is counted, and the multiplier portion multiplies the pulse signal output from the LC resonant circuit such that a bit sequence where the m-th bit of the count value is "1" and remaining bits are "0" is a component which is not changed according to the toner concentration.

7. A toner concentration detection method using the sensor device according to claim 1.

8. An image forming apparatus comprising the sensor device according to claim 1.

* * * * *